US009464875B2

(12) United States Patent
Bonavides et al.

(10) Patent No.: US 9,464,875 B2
(45) Date of Patent: Oct. 11, 2016

(54) DOUBLE SAFETY FIRING SYSTEM FOR INITIATORS

(71) Applicant: HALLIBURTON ENERGY SERVICES, INC., Houston, TX (US)

(72) Inventors: Clovis S. Bonavides, Houston, TX (US); William G. Dillon, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/360,419

(22) PCT Filed: Sep. 11, 2013

(86) PCT No.: PCT/US2013/059138

§ 371 (c)(1),
(2) Date: May 23, 2014

(87) PCT Pub. No.: WO2015/038110

PCT Pub. Date: Mar. 19, 2015

(65) Prior Publication Data

US 2016/0178334 A1 Jun. 23, 2016

(51) Int. Cl.

| | |
|---|---|
| ***E21B 43/1185*** | (2006.01) |
| ***F42D 1/045*** | (2006.01) |
| ***F42B 3/182*** | (2006.01) |

(52) U.S. Cl.

CPC ..... *F42B 3/182* (2013.01); *E21B 43/1185* (2013.01); *F42D 1/045* (2013.01)

(58) Field of Classification Search

CPC ..... E21B 43/116; E21B 43/1185; E21B 43/112; E21B 43/119; F42C 15/00; F42C 15/22; F42C 3/00; F42C 5/00; F42D 1/045; F42D 1/05; F42B 3/182

USPC ..... 102/200, 202.1, 202.3, 202.4, 206, 301, 102/322

See application file for complete search history.

(56) References Cited

U.S. PATENT DOCUMENTS

| | | | | |
|---|---|---|---|---|
| 2,615,080 | A * | 10/1952 | Mathews | E21B 43/119 102/301 |
| 3,185,093 | A | 5/1965 | Holinbeck | |
| 4,050,382 | A * | 9/1977 | Power | F42C 15/40 102/202.3 |
| 4,306,628 | A | 12/1981 | Adams, Jr. et al. | |

(Continued)

OTHER PUBLICATIONS

Jet Research Center, A Technical Description of the Rig Environment Detonator (RED®), JRC—A division of Halliburton Energy Services, Inc., Sep. 2009, p. 1-11, USA.

*Primary Examiner* — Jonathan C Weber
(74) *Attorney, Agent, or Firm* — McGuireWoods, LLP

(57) ABSTRACT

A double safety firing system comprises: a firing line, wherein an end of the firing line is directly or operatively connected to an electrically-activated initiator; a first safety sub-assembly, wherein the first safety sub-assembly is connected to the firing line and comprises: a first shunting line; and a first shunt disabler, wherein the first shunt disabler disables the first shunting line when a predetermined amount of force is applied to the first shunt disabler; and a second safety sub-assembly, wherein the second safety sub-assembly is connected to the firing line and comprises: a second shunting line; and a second shunt disabler, wherein the second shunt disabler disables the second shunting line when a predetermined amount of electric current is applied to the second shunt disabler, wherein after the first and second shunting lines are disabled, electric current flows through the firing line and activates the initiator.

21 Claims, 2 Drawing Sheets

(56) References Cited

U.S. PATENT DOCUMENTS

| | | | |
|---|---|---|---|
| 4,311,097 | A | 1/1982 | Backstein et al. |
| 4,967,048 | A | 10/1990 | Langston |
| 5,161,616 | A | 11/1992 | Colla |
| 5,165,489 | A | 11/1992 | Langston |
| 5,322,019 | A | 6/1994 | Hyland |
| 5,811,894 | A | 9/1998 | Buyers et al. |
| 6,470,803 | B1 | 10/2002 | Liu et al. |
| 6,779,605 | B2 | 8/2004 | Jackson |
| 8,113,119 | B2 | 2/2012 | Crawford |
| 8,424,455 | B2 | 4/2013 | Crawford, II |
| 2006/0254448 | A1 | 11/2006 | Alculumbre et al. |
| 2008/0134922 | A1 | 6/2008 | Grattan et al. |
| 2010/0005992 | A1 | 1/2010 | Crawford |
| 2012/0103223 | A1 | 5/2012 | Crawford |

* cited by examiner

DOUBLE SAFETY FIRING SYSTEM FOR INITIATORS

TECHNICAL FIELD

Initiators are used to cause detonation of explosive substances. Safety systems can be used to prevent premature activation of an initiator such that premature detonation does not occur. Explosive substances and safety systems can be used in a variety of industrial applications.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
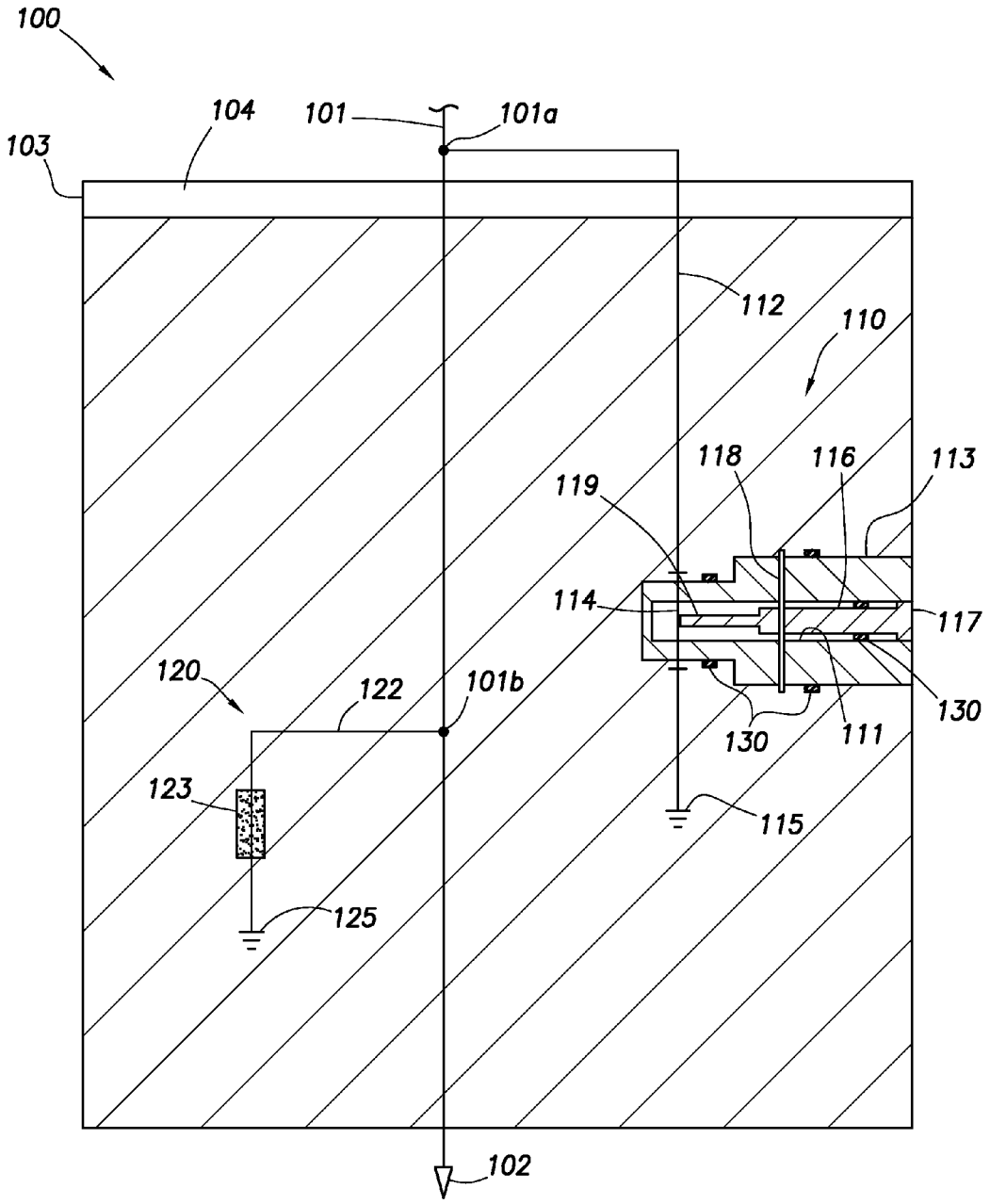
FIG. 1 is a schematic illustration of a double safety assembly including a first and second safety sub-assemblies according to certain embodiments.

As used herein, the words "comprise," "have," "include," and all grammatical variations thereof are each intended to have an open, non-limiting meaning that does not exclude additional elements or steps.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas or combinations thereof.

Explosive substances or charges are used in a variety of industries, including but not limited to, the construction industry, mining industry, military applications, demolition, and oil and gas industry. Explosives can be positioned inside a carrier. The explosives can be connected to a detonation cord. An initiator can be positioned adjacent to one end of the detonation cord. Generally, the activation of the initiator causes an explosion, the explosion ignites the detonation cord, which in turn ignites the explosives.

An initiator may be activated in response to external signals, for example a pressure signal or an electrical signal. Examples of electric initiators include, but are not limited to, exploding bridge wire initiators, slapper initiators (also known as an exploding foil initiator), and laser initiators. Electric initiators activate due to electrical current from a firing line to a contact pin or capacitor.

In the oil and gas industry, stimulation techniques can be used to help increase or restore oil, gas, or water production of a well. Oil and gas hydrocarbons are naturally occurring in some subterranean formations. In the oil and gas industry, a subterranean formation containing oil, gas, or water is referred to as a reservoir. A reservoir may be located on land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

One example of a stimulation technique is creating a perforation tunnel within a well by using shaped charges. The shaped charges can be detonated, thereby creating a communication path that extends into the formation. The communication path is called a perforation tunnel. The perforation tunnel permits the flow of fluids into or from the formation. The perforation tunnel may also allow fracturing fluids to access the formation.

Regardless of the industry, explosives can be susceptible to premature detonation. Premature activation of an electrically activated initiator, which causes detonation of the explosive, can be caused by a variety of conditions. For example, stray electrical current can be transmitted to the initiator by lightning, welding equipment, dust or snow storms, poor electrical grounding, or high-transmission power lines. Moreover, radio frequency (RF) energy from mobile devices, antennas, walkie talkies, etc., can also cause premature activation of the initiator. Needless to say, premature detonation of the explosives can result in serious injury or death to workers and cause damage to equipment.

Therefore, there is a need for a safety assembly that can prevent premature activation of an electrically activated initiator. It has been discovered that a safety assembly can include a first and second safety sub-assemblies. The first safety sub-assembly can be deactivated via application of a known amount of force. The second safety sub-assembly can be deactivated via application of a known amount of electric current. The double safety assembly prevents premature activation of the initiator because both safety sub-assemblies must be deactivated in order for the initiator to be activated.

According to an embodiment, a double safety firing system comprises: (A) a firing line, wherein an end of the firing line is directly or operatively connected to an electrically-activated initiator; (B) a first safety sub-assembly, wherein the first safety sub-assembly is connected to the firing line, and wherein the first safety sub-assembly comprises: (i) a first shunting line; and (ii) a first shunt disabler, wherein the first shunt disabler operatively connects the first shunting line with a ground, and wherein the first shunt disabler disables the first shunting line when a predetermined amount of force is applied to the first shunt disabler; and (C) a second safety sub-assembly, wherein the second safety sub-assembly is connected to the firing line, and wherein the second safety sub-assembly comprises: (i) a second shunting line; and (ii) a second shunt disabler, wherein the second shunt disabler operatively connects the second shunting line with a ground, and wherein the second shunt disabler disables the second shunting line when a predetermined amount of electric current is applied to the second shunt disabler, wherein after the first and second shunting lines are disabled, electric current flows through the firing line and activates the initiator.

According to another embodiment, a method of activating an initiator comprises: positioning the initiator in a desired location, wherein the initiator is electrically activated and wherein the initiator is operatively connected to the double safety firing system; causing or allowing the first shunting line to become disabled; and causing or allowing the second shunting line to become disabled, wherein after the first and second shunting lines are disabled, the initiator becomes activated.

Any discussion of the embodiments regarding the double safety firing system is intended to apply to all of the apparatus and method embodiments.

Turning to the figures, FIG. 1 is a schematic illustration of the double safety firing system according to certain embodiments. The double safety firing system 100 includes a firing line 101. An end of the firing line 101 is directly or operatively connected to an electrically activated initiator 200 (shown in FIG. 2). By way of example, an end of the firing line 101 can be connected to a contact pin 102, which is then connected to the initiator. The other end of the firing line 101 can be connected to a supply of electric current (not shown). The double safety firing system 100 can also include a housing 103 and a cap 104. The firing line 101 can run above, below, and through the housing 103. It is to be understood that any of the lines (e.g., the firing line or the shunting lines) can be made from any electrically conductive material. Any of the lines can also include a protective coating and/or insulating coating. The firing line 101 can also be connected to the housing 103 via the cap 104. The housing 103 can be made from a variety of materials, including but not limited to, metals and metal alloys. The initiator can be electrically activated when a specific amount of electric current flows through the firing line 101 to the initiator. The double safety firing system 100 prevents premature activation of the initiator.

The double safety firing system 100 includes a first safety sub-assembly 110. The first safety sub-assembly 110 can include a sub-assembly mount block, wherein the mount block connects the first sub-assembly to the housing 103 and/or cap 104. There can also be a first sub-assembly housing 113 that includes a piston 116. The piston 116 can reside in and travel within a piston cavity 111. The housing and piston can be connected to the mount block and retained in place using a retaining mechanism, for example a threaded retaining ring or a spring clip. One or more seals 130 provide hydraulic isolation from external fluids prior to and during movement of the piston or any component thereof. The piston 116 can be made from a high strength, electrical isolating material. The piston 116 can include a piston head 117 and a piston plunger 119. Movement of the piston head 117 can cause movement of the piston plunger 119. The piston plunger 119 can be prevented from moving via a frangible device 118. The frangible device 118 can be, for example, a shear pin, a shear screw, a load ring, a lock ring, a pin, or a lug.

The first safety sub-assembly 110 is connected to the firing line 101. The first safety sub-assembly 110 includes a first shunting line 112. The first safety sub-assembly 110 can be connected to the firing line 101 at a first junction 101*a* via the first shunting line 112. The first shunting line 112 shunts or displaces a flow path away from the initiator to the first safety sub-assembly. The first safety sub-assembly 110 also includes a first shunt disabler 114. The first shunt disabler 114 operatively connects the first shunting line 112 to a ground 115. According to an embodiment, the first shunt disabler 114 is made from an electrically conductive material. In this manner, an electric current can flow through the first shunting line 112 and through the first shunt disabler 114 to the ground 115. According to an embodiment, the first shunt disabler 114 is a frangible device (e.g., a shear pin, shear screw, etc.). The first shunt disabler 114 can be the same as or similar to the frangible device 118. The first shunt disabler 114 disables the first shunting line 112 when a predetermined amount of force is applied to the first shunt disabler 114. The force can be a mechanical force or a hydraulic force due to pressure from a fluid, such as a liquid or a gas or combinations thereof. The force can act on the piston head 117 to cause movement of the piston plunger 119 towards the first shunt disabler 114. When the predetermined amount of force is applied to the piston head 117, the piston plunger 119 shears or breaks the first shunt disabler 114. When the first shunt disabler 114 is sheared or broken, the first shunting line 112 is disabled. As used herein, the term "disabled" with reference to any shunting line means that an electrical flow path through a portion of the line is interrupted, ruptured, or broken such that electric current no longer flows past the portion of the line. Due to disablement, electric current no longer flows from the firing line 101 to the first shunting line 112, through the first shunt disabler 114 and to the ground 115. Therefore, the electric current from the firing line 101 is no longer diverted to the first safety sub-assembly 110.

The amount of force or the range of the amount of force required to disable the first shunting line 112 via shearing or breaking of the first shunt disabler 114 can be predetermined. In practice, the rupture strength of components 114 and 118 can be specified as a range below which it will not break (collapse) and above which it will assuredly break. As stated above, the first safety sub-assembly 110 can also include the frangible device 118. The frangible device 118 can shear or break under an amount of mechanical or hydraulic force. After shearing or breaking of the frangible device 118, the piston plunger 119 can move towards the first shunt disabler 114. The force required to shear or break the frangible device 118 and the first shunt disabler 114 can be the same or different. If the necessary force is different, then preferably the force required to shear or break the first shunt disabler 114 is less than the force required to shear or break the frangible device 118. In this manner, once the frangible device 118 is sheared or broken, the piston plunger 119 moves towards the first shunt disabler 114 and can now easily shear or break the first shunt disabler 114 to disable the first shunting line 112. The mechanical force can be applied to the piston head 117 via a worker or tool. The force, hydraulic or pneumatic, can be applied to the piston head 117 from a positive pressure differential between the pressure of an area of fluid located adjacent to the piston head and an area within the piston head. In this manner, the greater pressure from the outside of the piston head causes movement of the piston head. When the positive pressure differential reaches the predetermined amount of pressure, then the frangible device 118 and/or the first shunt disabler 114 are sheared or broken. The force rating (i.e., the amount of force required to shear or break the component) of the frangible device 118 and/or the first shunt disabler 114 can be preselected based on conditions expected to be encountered during the explosives operation. By way of example, if the explosives are to be used in an oil or gas operation and it is known that the hydrostatic pressure of a column of wellbore fluid at the desired explosive location is 3,000 pounds force per square inch (psi), then the force rating of the frangible device 118 can, be for example around 2,500 psi. The force rating of the first shunt disabler 114 can then be preselected around 2,000 psi. This ensures that once the frangible device 118 shears or breaks, then the first shunt disabler 114 will shear or break.

The double safety firing system 100 also includes a second safety sub-assembly 120. The second safety sub-assembly 120 is connected to the firing line 101. The second safety sub-assembly 120 includes a second shunting line 122. The second safety sub-assembly 120 can be connected to the firing line 101 at a second junction 101*b* via the second shunting line 122. The second shunting line 122 shunts or displaces a flow path away from the initiator to the second safety sub-assembly. The second safety sub-assembly 120 also includes a second shunt disabler 123. The second shunt disabler 123 operatively connects the second shunting line 122 to a ground 125. The second shunt disabler 123 can be any device that fails open via the application of the predetermined amount of electric current. The second shunt disabler 123 can be for example, a fuse, or any other device that fails electrically open. The second shunt disabler 123 disables the second shunting line 122 when a predetermined amount of electric current is applied to the second shunt disabler 123. The predetermined amount of electric current can also be in a desired range where the lower limit does not cause premature failure and the upper limit guarantees disabling. According to an embodiment, the predetermined amount of electric current is greater than the amount of stray electric current that may be encountered at a worksite. The predetermined amount of electric current can be supplied, for example, from a worker or other remote location, from the supply of electric current (not shown) to the firing line 101. The current can then flow to the second shunt disabler 123 and cause the shunt disabler to fail open. When the shunt disabler fails open, the second shunting line 122 is disabled. The second shunt disabler 123 can be designed to fail open in a desired amount of time, for example, slowly or quickly. Due to disablement, electric current no longer flows from the firing line 101 to the second shunting line 122, through the second shunt disabler 123 and to the ground 125. Therefore, the electric current from the firing line 101 is no longer diverted to the second safety sub-assembly 120.

As will be appreciated by those of ordinary skill in the art, in order to activate the initiator, deactivation of both the first safety sub-assembly 110 and the second safety sub-assembly 120 must occur. As discussed above, deactivation of the sub-assemblies occurs due to disablement of the first shunting line 112 and second shunting line 122. The order in which the shunting lines are disabled can vary or can occur simultaneously. By way of example, the first shunting line 112 can be disabled first via the application of the predetermined amount of force, and then the second shunting line 122 can be disabled via the application of the predetermined amount of electric current. Moreover, should one of the sub-assemblies accidentally be deactivated before it is desirable, then the other sub-assembly will prevent activation of the initiator until the predetermined amount of force, or electric current is supplied. In this manner, should one of the sub-assemblies fail or prematurely deactivate, then the other sub-assembly will protect workers and equipment.

According to an embodiment, electric current flows from the firing line 101 to the initiator only after deactivation of both the first safety sub-assembly 110 and the second safety sub-assembly 120. According to another embodiment, when electric current flows to the initiator, the initiator is activated. Activation of the initiator can ignite a secondary explosive like a detonation cord, which then causes detonation or deflagration of a third explosive substance.

Figure 2:
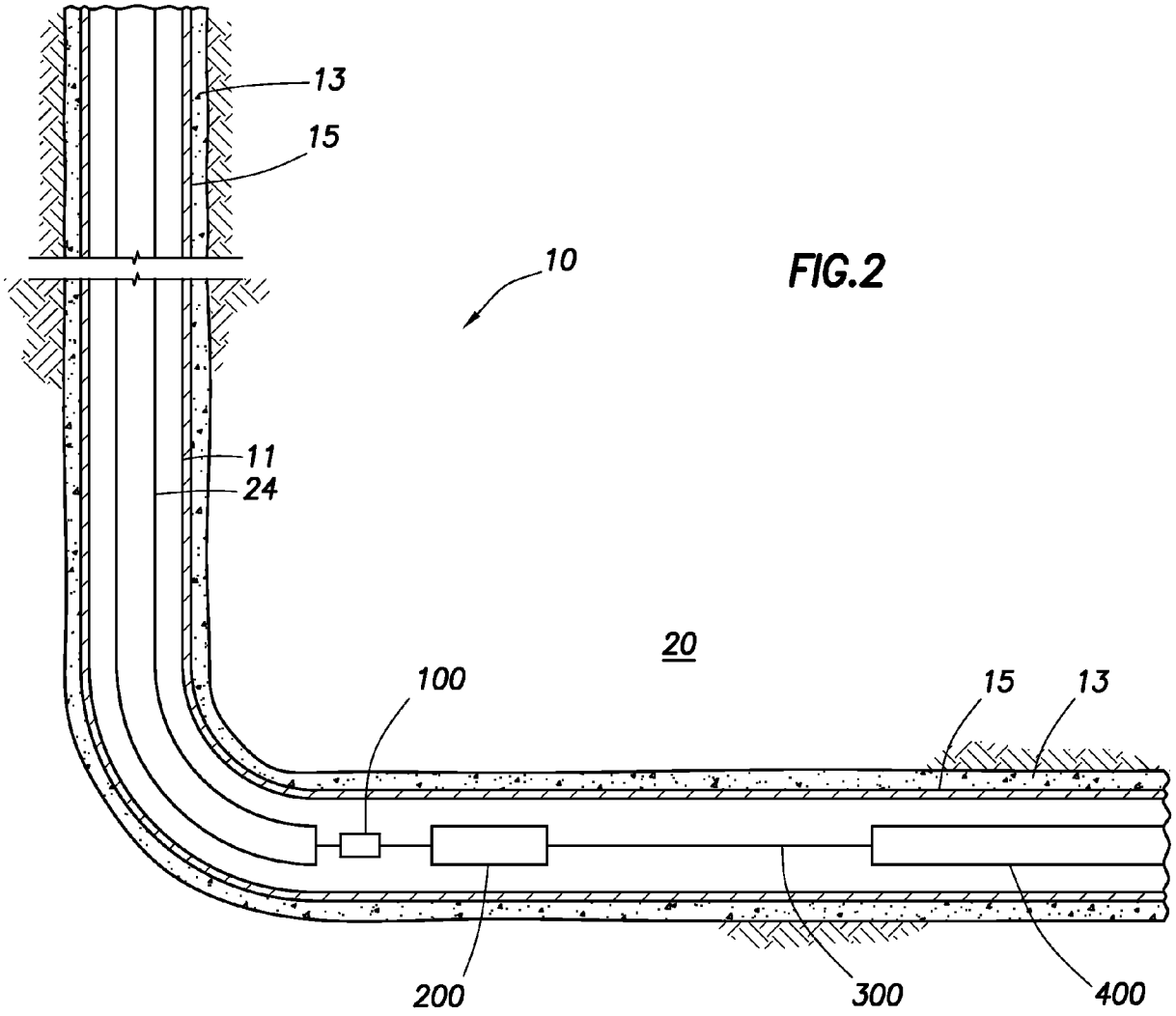
FIG. 2 is a schematic illustration of a well system containing the double safety assembly.

The double safety firing system 100 can be used in a variety of industries, including but not limited to, the construction industry, mining industry, military applications, demolition, and oil and gas industry. FIG. 2 depicts use in the oil and gas industry. The double safety firing system 100 can be used in a well system 10. The well system 10 can include a wellbore 11. The well system 10 can also include more than one wellbore 11. The wellbore 11 can penetrate a subterranean formation 20. The subterranean formation 20 can be a portion of a reservoir or adjacent to a reservoir. The wellbore 11 can have a generally vertical cased or uncased section (not shown) extending downwardly from a casing 15, as well as a generally horizontal cased or uncased section extending through the subterranean formation 20. The wellbore 11 can include only a generally vertical wellbore section or can include only a generally horizontal wellbore section.

A wireline 24 can be deployed in the wellbore 11. The well system 10 can comprise multiple zones (not shown). More than one double safety firing system 100 can be positioned in the well. It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include packers.

The double safety firing system 100 is connected to the initiator 200. The initiator 200 can be connected to the detonation cord 300. The double safety firing system 100, the initiator 200, and the detonation cord 300 can be enclosed in interconnected housings. The detonation cord 300 can be connected to an explosive 400. The explosive can be a charge, for example a shaped charge. The charge can be installed within a carrier, for example, a perforating gun. More than one double safety firing system 100, initiator 200, and explosive can be used. For example, there can be multiple systems aligned in parallel or series. In this manner, at least one explosive in multiple areas can be used in for a given operation. The number of components (e.g., the double safety firing system 100 or the explosives) and arrangement of the components can vary based on the intended use.

The methods include the step of positioning the initiator in a desired location. The step of positioning can also include positioning the double safety firing system 100 in a desired location. The methods also include causing or allowing the first shunting line 112 to become disabled. The step of causing can include applying at least the predetermined amount of a mechanical force to at least the piston head 117. The step of allowing can include allowing at least the predetermined amount of a hydraulic force to be exerted on the piston head 117. This can be accomplished, for example, once the first safety sub-assembly 110 reaches the desired location and a fluid pressure at the desired location is at least sufficient to cause the first shunt disabler 114 to shear or break.

The methods also include causing or allowing the second shunting line 122 to become disabled. The step of causing can include applying at least the predetermined amount of electric current to the second shunt disabler 123. The application of the electric current can include applying the current to the firing line 101, wherein the current is routed to the second shunting line 122 and to the second shunt disabler 123. As discussed above, the order in which the first shunting line 112 and second shunting line 122 are disabled can vary or occur simultaneously.

The methods can further include applying a specific amount of electric current to the firing line 101 after causing or allowing both the first shunting line 112 and second shunting line 122 to become disabled, wherein the application of the electric current to the firing line causes the initiator to become activated. The activation of the initiator can be caused by electrical activation of the initiator such that an explosive substance detonates or deflagrates. The methods can also include causing or allowing at least one explosive substance to detonate or deflagrate after activation of the initiator. Of course, there can be more than one explosive that is detonated or deflagrated.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A double safety firing system comprising:

(A) a firing line, wherein an end of the firing line is directly or operatively connected to an electrically-activated initiator;

(B) a first safety sub-assembly, wherein the first safety sub-assembly is connected to the firing line, and wherein the first safety sub-assembly comprises:

(i) a first shunting line; and (ii) a first shunt disabler, wherein the first shunt disabler operatively connects the first shunting line with a ground, and wherein the first shunt disabler disables the first shunting line when a predetermined amount of force is applied to the first shunt disabler; and (C) a second safety sub-assembly, wherein the second safety sub-assembly is connected to the firing line, and wherein the second safety sub-assembly comprises:

(i) a second shunting line; and (ii) a second shunt disabler, wherein the second shunt disabler operatively connects the second shunting line with a ground, and wherein the second shunt disabler disables the second shunting line when a predetermined amount of electric current is applied to the second shunt disabler, wherein after the first and second shunting lines are disabled, electric current flows through the firing line and activates the initiator.

2. The system according to claim 1, wherein the first safety sub-assembly is connected to the firing line at a first junction via the first shunting line.

3. The system according to claim 1, wherein the first shunting line shunts or displaces an electrical flow path away from the initiator to the first safety sub-assembly prior to application of the predetermined amount of force.

4. The system according to claim 1, wherein the first shunt disabler is made from an electrically conductive material.

5. The system according to claim 4, wherein the first shunt disabler is a frangible device.

6. The system according to claim 5, wherein the first safety sub-assembly further comprises a piston, wherein the piston is located adjacent to the first shunt disabler.

7. The system according to claim 6, wherein the piston is made from a high strength, electrical isolating material.

8. The system according to claim 6, wherein the piston comprises a piston head and a piston plunger, wherein movement of the piston head causes movement of the piston plunger.

9. The system according to claim 8, wherein the force acts on the piston head to cause movement of the piston plunger towards the first shunt disabler, wherein when the predetermined amount of force is applied to the piston head, the piston plunger shears or breaks the first shunt disabler.

10. The system according to claim 9, wherein when the first shunt disabler is sheared or broken, the first shunting line is disabled.

11. The system according to claim 10, wherein the first safety sub-assembly further comprises a frangible device, and wherein the piston plunger is prevented from moving via the frangible device.

12. The system according to claim 11, wherein the force required to shear or break the frangible device and the first shunt disabler is different, and wherein the force required to shear or break the first shunt disabler is less than the force required to shear or break the frangible device.

13. The system according to claim 1, wherein the force is a mechanical, a pneumatic, or a hydraulic force.

14. The system according to claim 1, wherein the second safety sub-assembly is connected to the firing line at a second junction via the second shunting line.

15. The system according to claim 1, wherein the second shunting line shunts or displaces an electrical flow path away from the initiator to the second safety sub-assembly prior to the application of the predetermined amount of electric current.

16. The system according to claim 1, wherein the second shunt disabler is any device that fails open via the application of the predetermined amount of electric current.

17. The system according to claim 16, wherein the second shunt disabler is a fuse.

18. The system according to claim 1, wherein the first shunting line is disabled before the second shunting line is disabled.

19. The system according to claim 1, wherein activation of the initiator causes detonation or deflagration of an explosive substance.

20. A method of activating an initiator comprising:

positioning the initiator in a desired location, wherein the initiator is electrically activated and wherein the initiator is operatively connected to a double safety firing system, wherein the double safety firing system comprises:

(A) a firing line, wherein an end of the firing line is directly or operatively connected to the initiator;

(B) a first safety sub-assembly, wherein the first safety sub-assembly is connected to the firing line, and wherein the first safety sub-assembly comprises:

(i) a first shunting line; and (ii) a first shunt disabler, wherein the first shunt disabler operatively connects the first shunting line with a ground, and wherein the first shunt disabler disables the first shunting line when a predetermined amount of force is applied to the first shunt disabler; and (C) a second safety sub-assembly, wherein the second safety sub-assembly is connected to the firing line, and wherein the second safety sub-assembly comprises:

(i) a second shunting line; and (ii) a second shunt disabler, wherein the second shunt disabler operatively connects the second shunting line with a ground, and wherein the second shunt disabler disables the second shunting line when a predetermined amount of electric current is applied to the second shunt disabler;

causing or allowing the first shunting line to become disabled; and causing or allowing the second shunting line to become disabled, wherein after the first and second shunting lines are disabled, the initiator becomes activated.

21. The method according to claim 20, further comprising causing or allowing at least one explosive substance to detonate or deflagrate after activation of the initiator.

* * * * *